US011614308B2

(12) United States Patent
DeBobes et al.

(10) Patent No.: US 11,614,308 B2
(45) **Date of Patent: *Mar. 28, 2023**

(54) WEAPON MOUNTABLE ILLUMINATION DEVICE

(71) Applicant: In-Extremis Design and Development, LLC, Foxfield, CO (US)

(72) Inventors: Dennis DeBobes, Foxfield, CO (US); Ryan Neel, Foxfield, CO (US); Jeffrey Jakubowski, Littleton, CO (US)

(73) Assignee: In-Extremis Design and Development, LLC, Foxfield, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/391,405

(22) Filed: Aug. 2, 2021

(65) Prior Publication Data

US 2021/0396491 A1 Dec. 23, 2021

Related U.S. Application Data

(63) Continuation of application No. PCT/US2021/038230, filed on Jun. 21, 2021, which is a continuation-in-part of application No. 16/906,698, filed on Jun. 19, 2020, now Pat. No. 11,112,217.

(51) Int. Cl.

| | |
|---|---|
| ***F41G 1/35*** | (2006.01) |
| ***F41G 11/00*** | (2006.01) |
| *F41H 13/00* | (2006.01) |

(52) U.S. Cl.

CPC ..... *F41G 11/003* (2013.01); *F41G 1/35* (2013.01); *F41G 11/004* (2013.01); *F41H 13/0056* (2013.01)

(58) Field of Classification Search

CPC ..... F41G 1/32; F41G 1/34; F41G 1/35

See application file for complete search history.

(56) References Cited

U.S. PATENT DOCUMENTS

| | | | |
|---|---|---|---|
| 2,085,732 | A | 7/1937 | Warner et al. |
| 2,101,479 | A | 12/1937 | Schenk |
| 4,856,218 | A | 8/1989 | Reynolds, Jr. |
| 5,064,988 | A | 11/1991 | E'nama et al. |
| 5,704,155 | A | 1/1998 | Primeau, IV |
| 5,822,905 | A | 10/1998 | Teetzel |
| 5,913,669 | A | 6/1999 | Hansen et al. |
| 7,264,369 | B1 | 9/2007 | Howe |
| 7,827,726 | B2 | 11/2010 | Stokes |
| 7,954,273 | B1 | 6/2011 | Swan |

(Continued)

FOREIGN PATENT DOCUMENTS

WO 2015105677 A1 7/2015

OTHER PUBLICATIONS

Notice of Allowance dated Jul. 9, 2021 issued in U.S. Appl. No. 16/906,698.

(Continued)

*Primary Examiner* — Derrick R Morgan

(74) *Attorney, Agent, or Firm* — Voz Patents

(57) ABSTRACT

A weapon mountable illumination device configured to mount to existing firearm mounting rails to provide illumination of potential targets while mitigating problems associated with snagging, and shadow casting. It is an aspect of the present invention to provide a rapidly mountable device to provide increased lighting capability while obviating the need to remove back up iron sights.

19 Claims, 15 Drawing Sheets

(56) References Cited

U.S. PATENT DOCUMENTS

| | | | |
|---|---|---|---|
| 8,001,715 | B2 | 8/2011 | Stokes |
| 8,201,353 | B1 | 6/2012 | Swan |
| 8,256,153 | B1 | 9/2012 | Noha et al. |
| 8,459,822 | B1 | 6/2013 | Lambert et al. |
| 8,484,882 | B2 | 7/2013 | Haley et al. |
| 8,683,733 | B2 | 4/2014 | Gross et al. |
| 8,739,447 | B2 | 6/2014 | Merritt et al. |
| 9,062,933 | B1 | 6/2015 | Allen et al. |
| 9,546,848 | B1 | 1/2017 | Burger et al. |
| 9,851,083 | B2 | 12/2017 | Pinilla |
| 9,958,226 | B2 | 5/2018 | Merritt et al. |
| 10,060,698 | B2 | 8/2018 | Mehki |
| 10,082,363 | B2 | 9/2018 | Burgess |
| 10,215,530 | B1 | 2/2019 | Watts et al. |
| 10,436,552 | B2 | 10/2019 | Gray |
| 10,955,217 | B2 | 3/2021 | Saadon |
| 10,969,201 | B1 | 4/2021 | Pischke |
| 2002/0100204 | A1 | 8/2002 | Kim |
| 2003/0226305 | A1 | 12/2003 | Burnett |
| 2005/0188827 | A1 | 9/2005 | McNulty |
| 2006/0010761 | A1 | 1/2006 | Staley |
| 2007/0039225 | A1 | 2/2007 | Kallio et al. |
| 2007/0039226 | A1 | 2/2007 | Stokes |
| 2007/0137087 | A1 | 6/2007 | Florea et al. |
| 2009/0122527 | A1 | 5/2009 | Galli |
| 2010/0154280 | A1 | 6/2010 | LaFrance et al. |
| 2011/0131859 | A1 | 6/2011 | Lawson |
| 2011/0255270 | A1 | 10/2011 | Gross et al. |
| 2012/0055061 | A1 | 3/2012 | Hartley et al. |
| 2012/0140201 | A1 | 6/2012 | Grauslys et al. |
| 2012/0180366 | A1 | 7/2012 | Jaroh et al. |
| 2012/0268920 | A1 | 10/2012 | Matthews et al. |
| 2013/0036646 | A1 | 2/2013 | Rubac et al. |
| 2013/0133236 | A1 | 5/2013 | Merritt et al. |
| 2014/0196342 | A1 | 7/2014 | Syrengelas et al. |
| 2014/0317988 | A1 | 10/2014 | Battis et al. |
| 2015/0233668 | A1 | 8/2015 | Moore |
| 2015/0247703 | A1 | 9/2015 | Teetzel et al. |
| 2015/0276352 | A1 | 10/2015 | Chang et al. |
| 2015/0300386 | A1 | 10/2015 | Fong et al. |
| 2016/0010949 | A1 | 1/2016 | Teetzel et al. |
| 2016/0033232 | A1 | 2/2016 | Cheng et al. |
| 2016/0061560 | A1 | 3/2016 | Saadon |
| 2016/0102943 | A1 | 4/2016 | Teetzel et al. |
| 2016/0161214 | A1 | 6/2016 | Eble |
| 2017/0038178 | A1 | 2/2017 | Pinilla |
| 2017/0159921 | A1 | 6/2017 | Morris |
| 2017/0205202 | A1 | 7/2017 | Teetzel et al. |
| 2017/0268849 | A1 | 9/2017 | Conner et al. |
| 2017/0276452 | A1 | 9/2017 | Barnette |
| 2017/0363385 | A1 | 12/2017 | Saadon |
| 2018/0094900 | A1 | 4/2018 | Sharrah et al. |
| 2018/0142991 | A1 | 5/2018 | Rogers et al. |
| 2018/0219349 | A1 | 8/2018 | Lemire et al. |
| 2018/0292170 | A1 | 10/2018 | Gagliano et al. |
| 2018/0328693 | A1 | 11/2018 | Mayberry et al. |
| 2019/0049221 | A1 | 2/2019 | Zimmer |
| 2020/0132414 | A1 | 4/2020 | Shelton et al. |
| 2020/0200508 | A1 | 6/2020 | Teetzel et al. |
| 2020/0232737 | A1 | 7/2020 | McClellan et al. |
| 2020/0240750 | A1 | 7/2020 | Reed et al. |
| 2020/0363160 | A1 | 11/2020 | Pigott et al. |
| 2021/0088310 | A1 | 3/2021 | Planck |

OTHER PUBLICATIONS

Search Report dated Sep. 23, 2021 issued in PCT/US21/38230.
Written Opinion dated Sep. 23, 2021 issued in PCT/US21/38230.

WEAPON MOUNTABLE ILLUMINATION DEVICE

CROSS REFERENCE TO RELATED APPLICATIONS

This application claims the benefit of PCT Application PCT/US21/38230 filed on Jun. 21, 2021, which is a continuation-in-part of U.S. patent application Ser. No. 16/906,698 entitled "WEAPON MOUNTABLE ILLUMINATION DEVICE" filed on Jun. 19, 2020, the entire contents of which is incorporated herein by reference in its entirety for all purposes.

FIELD OF THE INVENTION

The present invention is directed to a weapon mountable illumination device which is intended to provide a modular and mobile lighting solution which mitigates problems associated with snagging, shadow casting, imbalance associated with the mounting to a weapon, and overheating of elements.

BACKGROUND OF THE INVENTION

In the conduct of law enforcement and military operations, weapon-mounted tactical lighting has become mission critical equipment in most operations wherein such equipment provides a high level of value in achieving success in a given operation.

Handheld tactical lighting, generally used with pistols, requires the use of one hand to operate the weapon while the other hand of the operator is used to illuminate targets or areas of interest beyond the muzzle-end of the weapon.

Weapon-mounted lighting, commonly used with long guns (shotguns, rifles, carbines, and other longer barreled firearms) allows the use of both hands in operating the weapon while providing illumination to targets or areas of interest beyond the muzzle-end of the weapon. Although weapon-mounted lighting is typically used with long guns which require two-handed operation, weapon-mounted lighting has also been adapted for use on pistols.

Weapon-mounted lighting in weapon centric operations allows an operator a commonly used term for personnel involved in military operations to provide illumination generally in the direction of the muzzle of the weapon while maintaining use of both hands for weapon handling and other operation related tasks.

Benefits of weapon-mounted lighting typically include: positive target identification in low-light situations, disorientation and/or temporary blinding of targets, or emitting infrared light for the purposes of illumination of areas in the event the operator is using night-vision enabling equipment.

SUMMARY OF THE INVENTION

An existing solution surrounding weapon-mounted lighting involves the mounting of a traditionally-shaped, cylindrical flashlight to the side of the weapon. Due to the placement of the flashlight on the side of the weapon, this can result in the casting of a shadow on the opposite side of the barrel from where the flashlight is mounted. A shadow in low-light operations can result in a potential target or threat being obscured from illumination, thus creating a potentially life-threatening situation for the operator.

A common tactic in efforts to mitigate the casting of a shadow involves the mounting of the flashlight as far forward and closer to the muzzle-end of the weapon, such as seen in U.S. Pat. No. 7,941,960 to Matthews, et al. ("Matthews") incorporated in its entirety herein for all purposes. Although this decreases the casting of shadows, this results in negatively affecting the weapon's weight and balance. Resultantly, the operator's ability to accurately engage targets is also negatively affected. Furthermore, the mounting of a flashlight toward the muzzle-end of a weapon creates a protuberance which can result in the snagging or catching of the weapon on obstacles including, but not limited to, communication cords, pistol lanyards, seatbelts, wires, or other cable-like lines present in military and/or law enforcement vehicles, boats, and aircraft. While conducting vehicle-mounted operations, it is optimal for an operator to be able to exit the vehicle quickly and bring the weapon to bear with zero interference. Prior art illumination devices (i.e. externally attached cylindrical flashlight-shaped devices) serve as a prominent encumbrance to speed and accuracy. The positioning of a standard external flashlight is such that the vehicle seatbelt or harness will likely clear the barrel of the gun, but grab the light fixture, causing not only a delayed exit, but more importantly a negative impact to the operator's ability to accurately engage threats. Operators have reported incidents of weapon-mounted flashlights catching on obstacles during ship-boarding operations, close-quarters combat operations, room-clearing operations, and during rappelling operations from buildings or fast-rope operations from helicopters. An operator catching their weapon in any operation can pose a life-threatening risk. For instance, during a rappelling or fast-rope operation, the catching of one's weapon can result in an uncontrolled fall from heights in excess of 40 feet.

Embodiments of the present invention surround a weapon-mounted illumination device providing lighting for an operator in a manner which does not cast shadows and provides streamlined form factor which provides snag-free operation due to the form factor in close proximity with existing aspects of the weapon.

Solutions to the above discussed problems have been proposed involving the mounting of a lighting device, such as a flashlight, to a weapon aligned with the muzzle-end of the firearm. The problem with such solutions surrounds the percussion and heat associated with the repeated firing of the firearm. The percussion and heat adversely affect the performance of the lighting device, as well as the operation of the weapon. The side-mounting of a flashlight to the forward aspect of a weapon may negatively affect the intended operation of the weapon due to imbalance and result in weapon malfunction.

A rail interface system commonly referred to as a "rail", "rail integration system", "rail accessory system" is a standardized apparatus of the attachment of accessories to firearms. Rail interface systems commonly provide a handguard offset surface of a barrel, wherein the handguard has one or more rails in accordance with MIL-STD-1913, STANAG 4694 specifications, or other rail interface systems known to those skilled in the art. The rail interface system allows the rapid attachment of accessories to a firearm by sliding the accessory onto a rail having undercuts, resulting in a T-shaped rail, and locked into place. A commonly used rail interface system for carbine weapons, such as the M-4, M-16, and AR-15, is commonly referred to as a "Picatinny Rail" although embodiments of the present invention are configured to interconnect with all rail accessory systems known to those skilled in the art. Certain rail interface systems provide handguard, configured to mount axially around a barrel of a firearm, having a total of four rails angularly offset at 90-degree increments, resulting in an octagonal profile wherein alternating surfaces have an accessory rail such that a top surface, bottom surface, left surface, and right surface of the handguard have accessory rails. It is an aspect of certain embodiments to provide an illumination device configured to slidably mount to a rail interface system having an octagonal profile. It is an aspect of certain embodiments of the present invention to be slidably mountable to a rail integration system having at least one rail integration system.

It is an aspect of certain embodiments to interconnect with firearm accessory mounting systems such as those disclosed by U.S. Pat. No. 8,925,236 to Mayberry, at al. ("the '236 patent"), U.S. Pat. No. 9,239,209 to Mayberry, at al. ("the '209 patent"), and U.S. Pat. No. 9,239,210 to Mayberry, at al. ("the '210 patent"), each of which are incorporated by reference in their entirety for all purposes. It will be appreciated that the mounting of the present invention disclosed herein to weapon accessory mounting systems known to those skilled in the art, such as those commonly known as KeyMod® and M-LOK®, are within the spirit and scope of the present invention.

Certain existing technologies, such as U.S. Patent Publication No. 2017/0038178 to Pinilla ("Pinilla"), herein incorporated by reference in its entirety for all purposes, propose a solution wherein a lighting device is integrated into a rail interface system. Pinilla teaches the incorporation of an illumination device within an internal aspect of a rail interface system wherein lighting elements are disposed between the rail interface system and the placement of the batteries creating a protuberance above where a top rail of the rail interface system would otherwise be. Furthermore, the removal of the illumination device of Pinilla requires the removal of the rail interface system as opposed to the removal of the illumination device alone. The close proximity of electrical and battery elements to the barrel would result in the exposure of electrical elements and batteries to high heat and percussion. Furthermore, the protuberance of the battery compartment negates the use of the top rail of the rail interface system and precludes the mounting of certain accessories to the weapon.

It is an aspect of the present invention to provide a weapon-mounted illumination device which is modular and does not limit the mounting of accessories to a rail interface system when the illumination device is not necessary. It is a further aspect of the present invention to allow the mounting of an illumination device as desired—toward the forward end (muzzle end) of the weapon, or further aft, dependent on the operator's preference or arm length and other physical body characteristics without impediment to or front existing elements such as back-up iron sights. It is a further aspect of the present invention to allow the attachment and removal of an illumination device without requiring the removal of the front-sight post.

It is an aspect of the present invention that the mounting of an illumination device mounted to a weapon's rail interface system does not inhibit or interfere with the mounting or operational use of traditional sights such as Backup Iron Sights (BUIS) or other commonly used sighting systems including, but not limited to products manufactured by: Aimpoint®, ACOG®, EOTECH® or AR-Scopes®.

It is a further aspect of the present invention to maintain the functionality of the top rail of a rail interface system when an illumination device is mounted to the weapon's rail interface system. Certain embodiments of the present invention surround the use of a cuff form having an open top aspect wherethrough the top aspect of a firearm is received. This allows an operator to rapidly affix or remove the present invention from the firearm without impediment to or from aspects of the weapon such as backup iron sights, the slide of a semi-automatic pistol, or accessories mounted to the top aspect of the weapon using a rail interface system.

Existing solutions, such as Pinilla, teach the use of a wired remote illumination activation switch which is placed remotely from the illumination device in close proximity to the operator's hands, such as near the trigger-guard of the weapon. Such switches may result in unintentional activation of the illumination device which may inadvertently alert a target to the presence of an operator during covert operations, or reduce the visual acuity of a fellow operator resulting in potentially dangerous circumstances.

It is an aspect of the present invention to provide an illumination device wherein activation switches are configured in a manner which mitigates accidental actuation to prevent the inadvertent turning of the illumination device on or off. Switches of certain embodiments are integrated into the weapon mountable illumination device to provide tactile control of power and alternative functions of the weapon mountable illumination device. Certain embodiments include switches on both the left side and the right side of the weapon mountable illumination device thereby allowing the ambidextrous functionality during operations.

It is an aspect of the present invention to provide a power indicator to an operator in a manner which is seen only by the operator in a non-distracting manner. Certain embodiments comprise a pin-hole sized blue-light facing rearward such that the blue power indicator is viewable by an operator when the weapon is held in a firing position.

It is an aspect of certain embodiments to provide annular or semi-annular lighting as opposed to individual beam configurations as found with a flashlight mounted on the side of a weapon. Annular lighting provides lighting from 360-degrees around the barrel of the weapon and illuminates beyond the muzzle-end of the weapon. As such, an annular lighting solution negates the shadow casting effects of a beam lighting configuration. It will be appreciated that annular lighting, for the purposes of this instant application includes but is not limited to the use of a continuous annular lighting element, a plurality of lighting elements (such as LEDs) disposes at radial intervals surrounding the barrel of a weapon, or one or more lighting elements configured to distribute illumination around the barrel of the weapon.

Certain existing technologies, such as U.S. Pat. No. 7,954,273 to Richard Swan ("Swan), U.S. Patent Publication No. 2009/0122527 to Robert Galli ("Galli"), U.S. Patent Publication No. 2007/0039226 to John Stokes ("Stokes"); and U.S. Pat. No. 9,062,933 to John Allen, et al. ("Allen")—each herein incorporated by reference in its entirety for all purposes—attempt to provide lighting forward of an operator's weapon. However, such technologies do not solve shadow-casting associated with the forward aspect of the weapon Some of such technologies, such as Swan, do not allow the adjustability of the device to permit an operator to place the lighting device at a desired distance to permit access to the device, or to allow as use as an ancillary grip, within reach for functions such as turning the illumination device on and off.

It is an aspect of the present invention to provide a weapon mountable illumination device which mitigates shadow casting though the use of a plurality of lighting elements configured to provide illumination forward of a firearm and operator. It will be appreciated that the term "forward" as used herein is not limited to a unidirectional aspect, but all aspects which are forward of the weapon and operator including a hemispherical field of view. It is an aspect of certain embodiments that a plurality of lighting elements work in concert to provide illumination forward of the firearm in a manner that the light cast provides a harmonized and/or uninterrupted lighting effect.

A further aspect of certain embodiments of the present invention include multiple functionalities such as, but not limited to: strobing, pattern flashing, white light, infrared illumination, colored LED light such as red or green light, and less-lethal functionality such as those taught by U.S. Pat. No. 6,190,022 to Tocci, et al. ("Tocci") incorporated herein in its entirety for all purposes. It is a further aspect of certain embodiments to allow the selection of particular modes through the use of a selector switch.

It is an aspect of the present invention to allow the operation of a laser independently of a lighting element. It is a further aspect of the present invention to allow the selection of a first mode of the operation of the laser and lighting elements wherein contacting or depressing the respective switch toggles the laser or lighting element on until the switch is contacted again. Another aspect of the present invention allows the selection of a second mode of the operation of the laser and lighting elements wherein contacting or depressing the respective switch toggles the laser or lighting element on until the respective switch is released. Yet another aspect of the present invention allows the selection of a second mode of the operation of the laser and lighting elements wherein contacting or depressing the respective switch does not illuminate the laser or lighting element thereby preventing inadvertent illumination as may be desired in clandestine operations or simply to conserve battery power.

Certain embodiments of the present invention comprise an illumination device mountable to a rail interface system wherein the illumination device is independent of a weapon foregrip and mounted adjacent to the barrel, while embodiments comprising an integrated foregrip for a weapon are within the spirit and scope of the present invention.

Embodiments of the present invention comprise an illumination device manufactured from aluminum, durable polymers, composites and/or rubber. It will be appreciated however, that embodiments constructed with alternative materials known to those skilled in the art are within the scope and spirit of the present invention.

It is an aspect of certain embodiments to provide an illumination device which is neutrally buoyant such that when used in water-based operations, the illumination device does not affect the buoyancy of the weapon and system of accessories in a positive or negative manner.

Existing solutions such as those taught by Pinilla rely on the operator engaging the forward aspect of a firearm by the handguard or rail, such as a Picatinny rail. These handguards and shrouds rely on an operator to engage the forward aspect of the firearm with an upward-turned hand and gripping the handguard or rail. When gripping a handguard, an operator may find the need to continually readjust their grip of the firearm, wherein these moments in which an operator readjusts their grip may result in impaired ability to respond quickly to a threat.

It is an aspect of certain embodiments to provide a finger hold which extends downward from the forward aspect of the weapon wherein an operator is able to engage the firearm mounted illumination device with at least one finger to provide further support and stabilization to the forward aspect of the firearm. A finger hold as disclosed herein provides a specific location for an operator to engage the forward aspect of the firearm consistently and repeatedly. When engaged with a finger hold, an operator is able to support the firearm vertically while pulling the firearm toward themselves to increase support, maneuverability, and move the firearm more quickly. Furthermore, the use of a finger grip interconnected with the firearm mounted illumination device mitigates the need to readjust grip during operations.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1A:
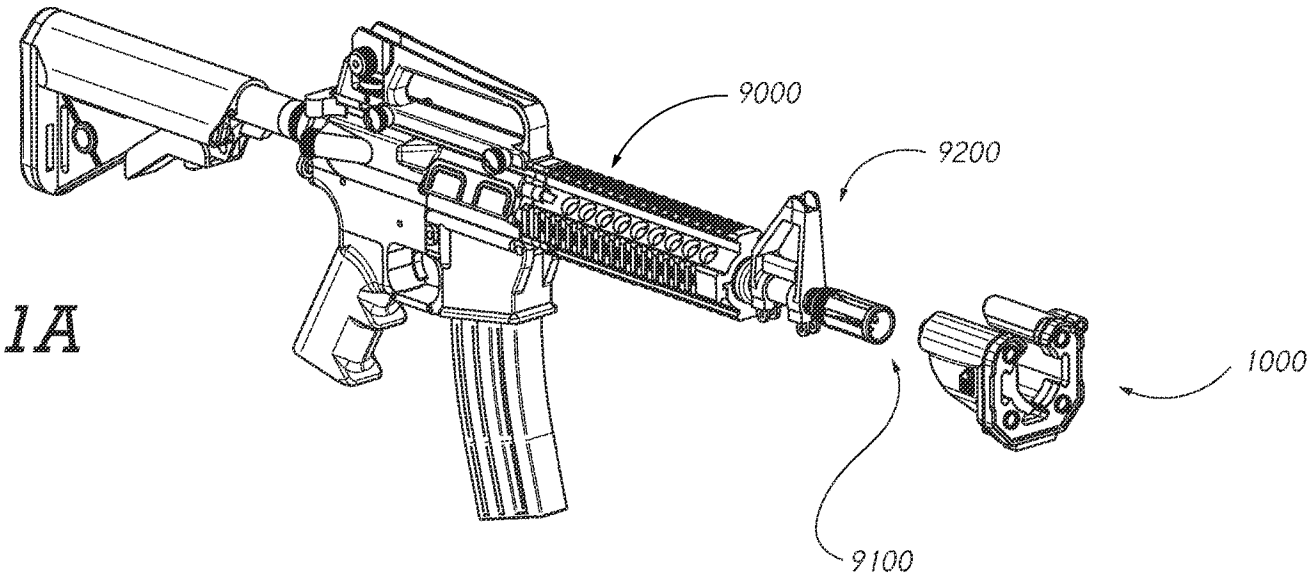
FIG. 1A—An exploded perspective view of certain embodiments of a weapon mountable illumination device for assembly with a firearm FIG. 1B—A perspective view of certain embodiments of a weapon mountable illumination device assembled with a firearm FIG. 2A—A front view of certain embodiments of a weapon mountable illumination device FIG. 2B—A rear view of certain embodiments of a weapon mountable illumination device FIG. 3A—A front view of certain embodiments of a weapon mountable illumination device FIG. 3B—A front view detail of certain embodiments of a weapon mountable illumination device shown in FIG. 3A FIG. 3C—A front view of certain embodiments of a weapon mountable illumination device assembled with a firearm FIG. 4—A front perspective view of certain embodiments of a weapon mountable illumination device FIG. 5—A system representation of certain embodiments of a weapon mountable illumination device FIG. 6—A rear perspective view of certain embodiments of a weapon mountable illumination device FIG. 7A—A top view of certain embodiments of a weapon mountable illumination device FIG. 7B—A bottom view of certain embodiments of a weapon mountable illumination device FIG. 7C—A left side view of certain embodiments of a weapon mountable illumination device FIG. 7D—A right side view of certain embodiments of a weapon mountable illumination device FIG. 8A—A front view of certain embodiments of a weapon mountable illumination device FIG. 8B—A rear view of certain embodiments of a weapon mountable illumination device FIG. 9—A front perspective view of certain embodiments of a weapon mountable illumination device FIG. 10—A rear perspective view of certain embodiments of a weapon mountable illumination device FIG. 11A—A left side view of certain embodiments of a weapon mountable illumination device FIG. 11B—A right side view of certain embodiments of a weapon mountable illumination device FIG. 11C—A top view of certain embodiments of a weapon mountable illumination device in a locked configuration FIG. 11D—A bottom view of certain embodiments of a weapon mountable illumination device FIG. 12A—A front view of certain embodiments of a weapon mountable illumination device in a locked configuration FIG. 12B—A top view of certain embodiments of a weapon mountable illumination device in a locked configuration
Figure 1B:
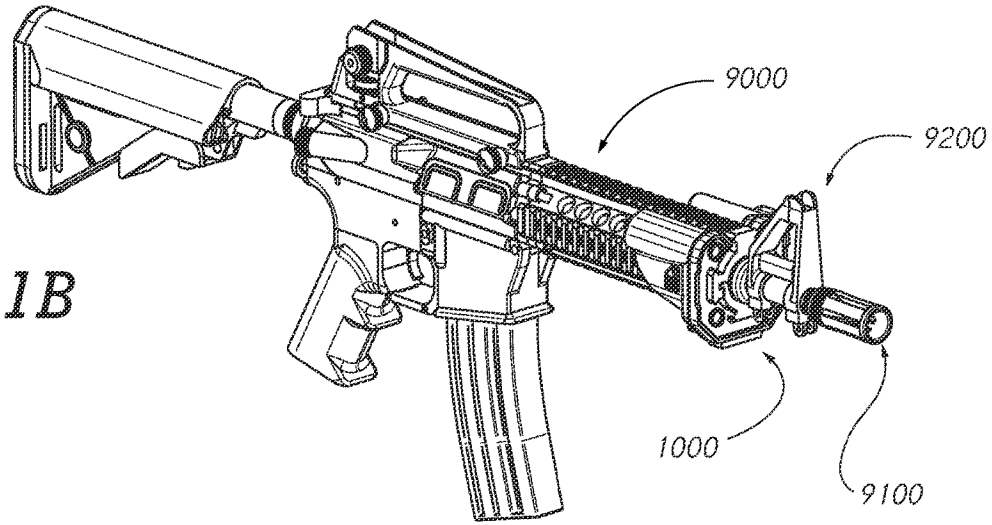
Figure 2A:
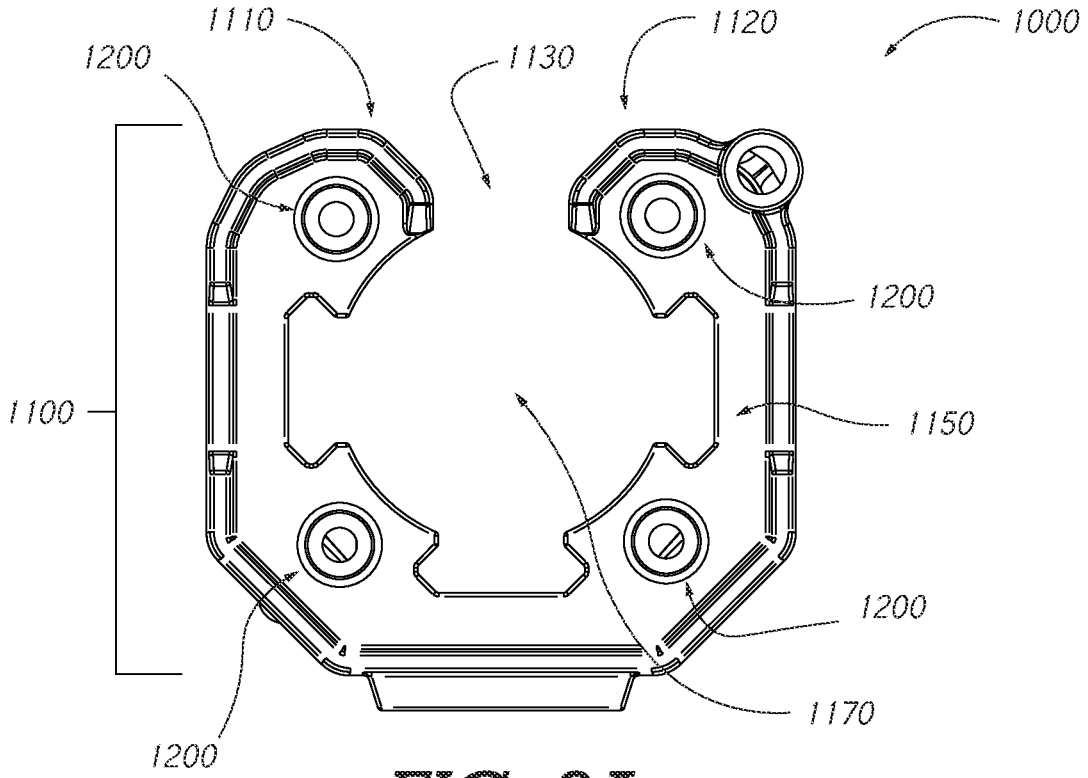
Figure 2B:
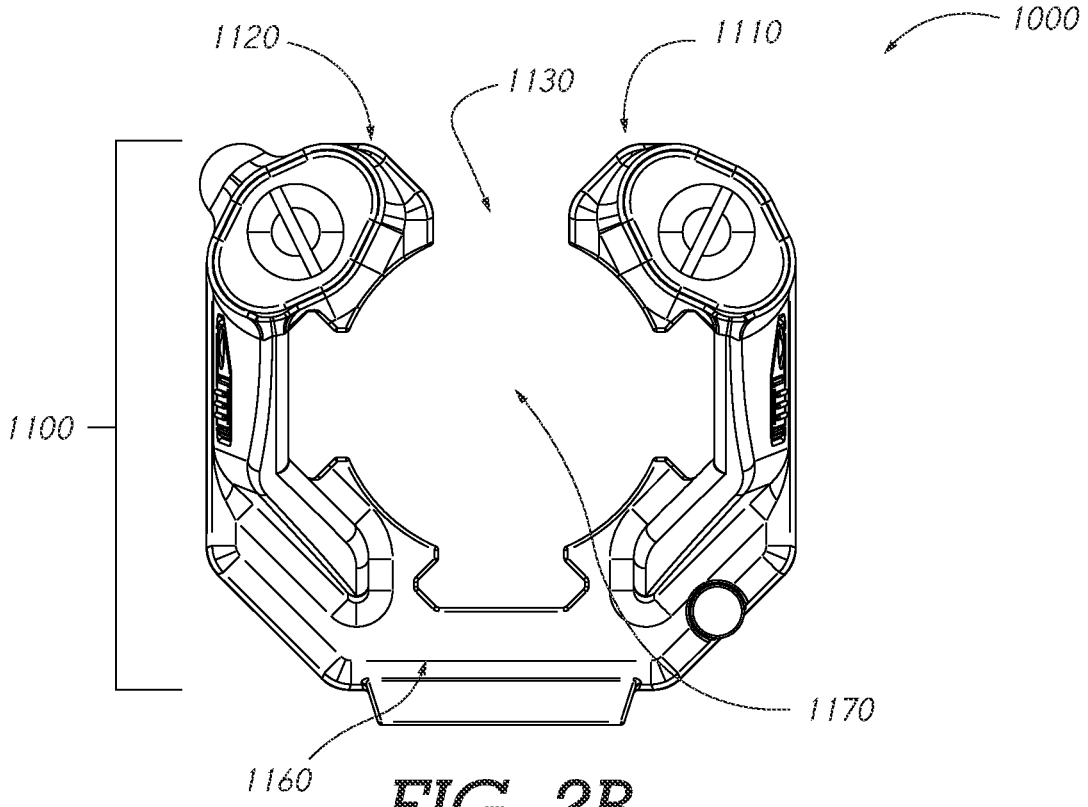

Certain embodiments of the present invention, such as shown in FIG. 1A-FIG. 1B, comprise a weapon mountable illumination device 1000 configured to slidably affix to the forward end of a firearm 9000 for providing illumination toward a forward aspect 9100, or muzzle end, of the firearm 9000.

Certain embodiments comprise a weapon mountable illumination device 1000, as seen in FIG. 2A-FIG. 2B and FIG. 8A-FIG. 8B, which has a cuff form 1100 wherein the cuff form has a first end 1110, a second end 1120, and a gap 1130 disposed therebetween. The gap 1130 extends longitudinally between the first open side 1150 and the second open side 1160 resulting in an open cuff which extends between a first end 1110 and a second end 1120 wherein the cuff less than 360-degrees between the ends. The weapon mountable illumination device 1000 comprises a first open side 1150, a second open side 1160, and a pathway 1170 there between. The gap 1130 of the cuff form is configured to allow the mounting to a firearm 9000, now referencing FIG. 1A-FIG. 1B, without impediment to or from existing elements of the firearm such as fixed iron sights 9200 or backup iron sights (BUIS), a slide of a semi-automatic pistol, or other aspects, or accessories mounted to a top aspect of a firearm such as those mounted to a rail system.

Certain embodiments of a weapon mountable illumination device 1000, as seen in FIG. 2A-FIG. 2B and FIG. 8A-FIG. 8B, comprise at least one lighting element 1200 configured to shine in a forward direction, while certain embodiments comprise a plurality of lighting elements 1200. Further embodiments still comprise a singular lighting element configured to provide annular or semi-annular lighting.

Figure 3A:
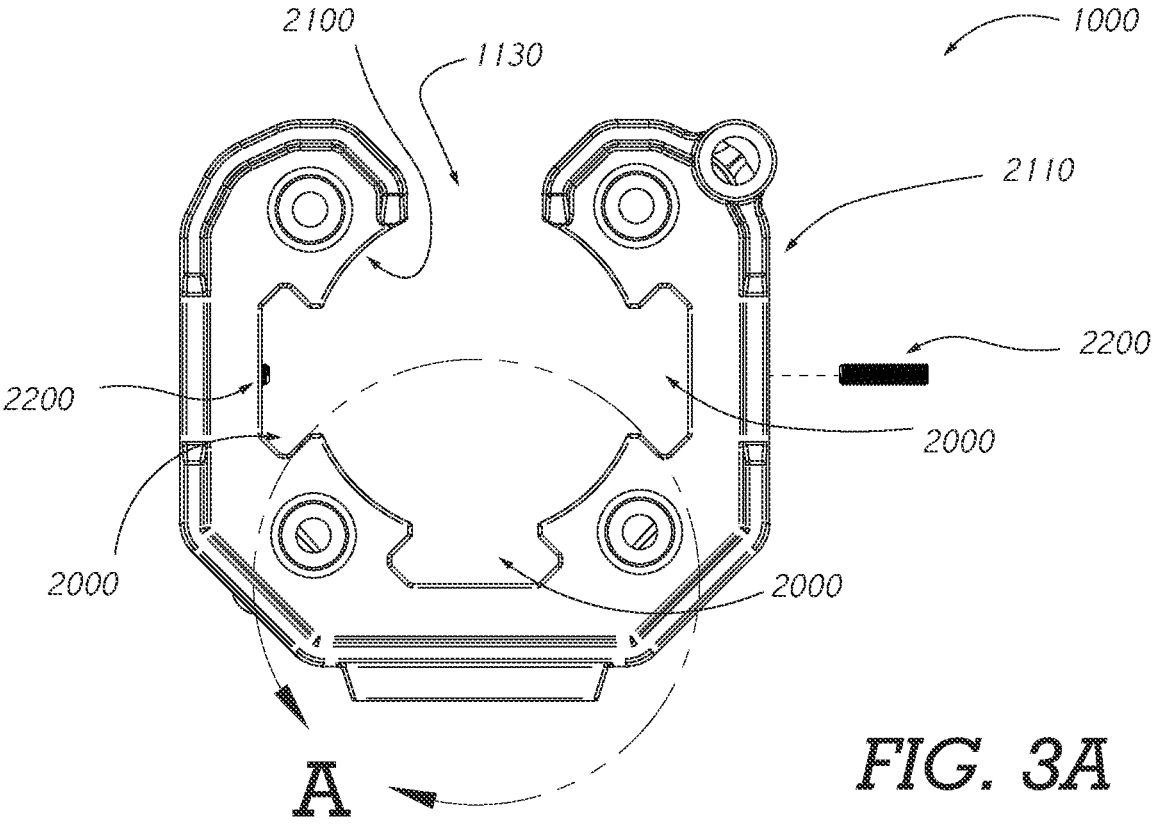

Certain embodiments of the present invention, such as shown in FIG. 3A, comprise a weapon mountable illumination device having a first channel 2000 in an internal perimeter 2100 of the cuff form 1100. The channel 2000 has an angular offset of 180-degrees from the gap 1130 of the cuff form 1100. The channel 2000 is configured to allow the slidable interconnection and removal of the weapon mountable illumination device 1000 to and from a firearm 9000 (FIG. 1A-FIG. 1B).

In certain embodiments, again referencing FIG. 3A, the cuff form 1100 further comprises a set screw 2200 extending from an external perimeter 2110 of the cuff form through the internal perimeter of the cuff form. The set screw 2200 is configured to extend radially inward from the internal perimeter 2100 of the cuff form and engage with the firearm, thereby affixing the weapon mountable illumination device to the firearm. Certain embodiments within the spirit and scope of the present invention comprise a plurality of set screws 2200. It will be appreciated by those skilled in the art that the attachment of a weapon mountable illumination device is not limited to the use of set screws 2200. Embodiments comprising elements configured to be threadably advanced, slidably advanced, or through the use of spring-loaded elements such as ball detents to engage with a firearm, aspects of a rail interface system, or elements thereof are within the spirit and scope of the present invention. It will be further appreciated that the use of quick-disconnect elements such as disclosed in U.S. Pat. No. 7,823,315 to Webber et al. ("Webber"), U.S. Pat. No. 8,857,097 to Rorick ("Rorick"), U.S. Pat. No. 8,336,247 to Haering ("Haering"), and U.S. Pat. No. 8,397,421 to Ding, et al. (Ding") each of which are incorporated herein in its entirety for all purposes, are within the spirit and scope of the present invention.

Figure 3B:
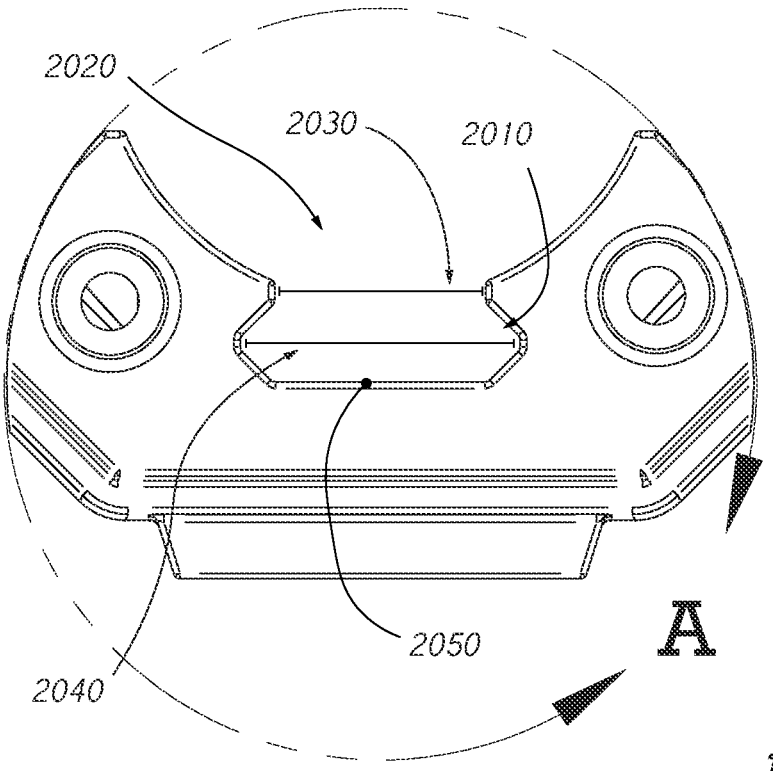
Figure 3C:
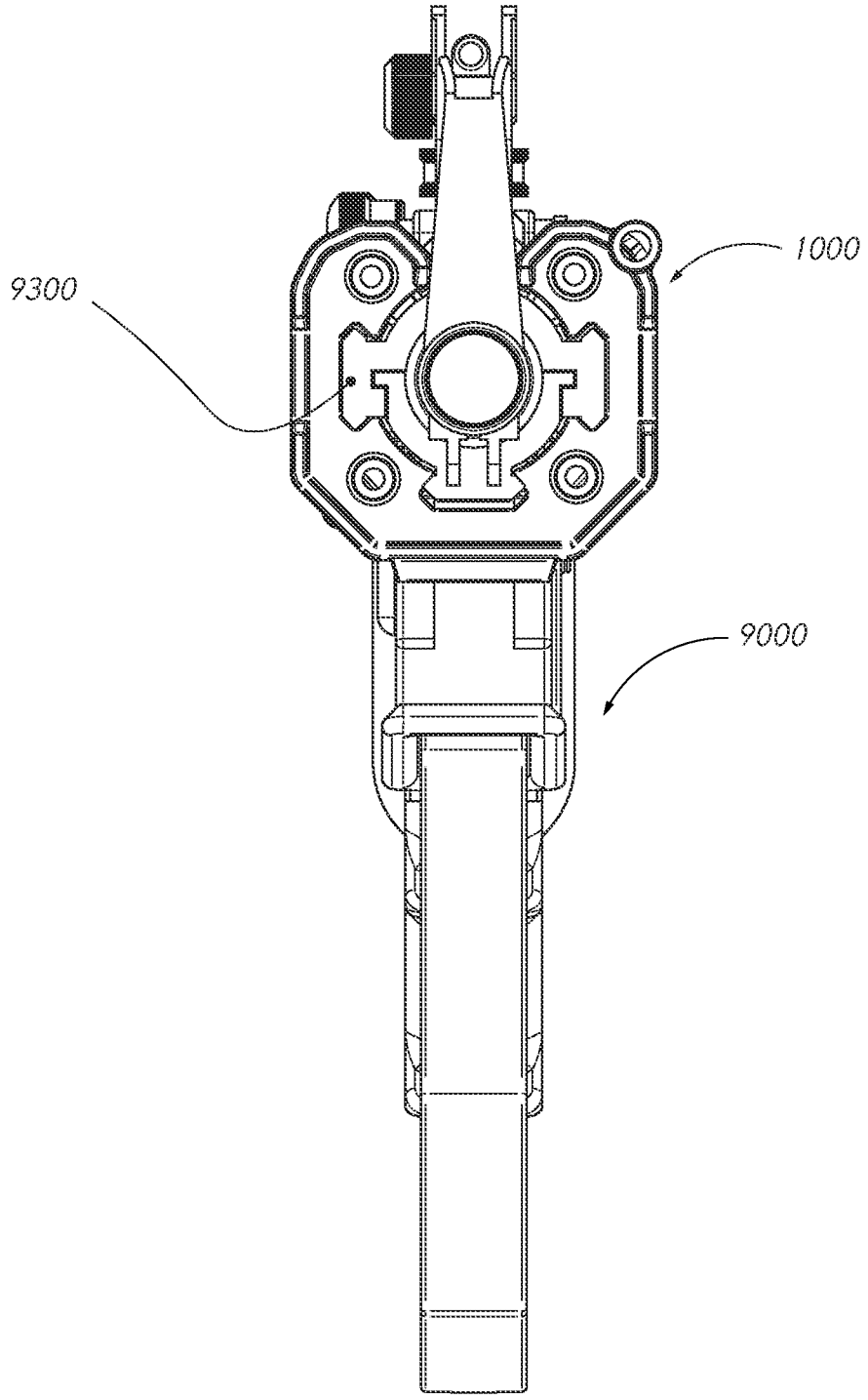

In certain embodiments, as shown in FIG. 3A-FIG. 3C, a weapon mountable illumination device 1000 comprises a channel 2000 configured to receive a rail interface system 9300. A rail interface system as disclosed herein refers to MIL-STD-1913, STANAG 4694 specifications, as well as any rail interface system known to those skilled in the art.

In certain embodiments, shown in FIG. 3A-FIG. 3C, a weapon mountable illumination device comprises a channel 2000 having undercut sidewalls 2010. It will be appreciated that undercut, as used herein refers to a manufacturing "undercut" resulting in a recessed surface that is inaccessible using a straight tool. In certain embodiments, a channel having undercut sidewalls 2010 is characterized by having an opening 2020 of a first width 2030, and a second width 2040 located between the opening and the bottom 2050 of the channel, wherein the second width is greater than the first width.

Certain embodiments, such as shown in FIG. 3A, comprise a plurality of channels 2000 angularly offset from each other around the internal perimeter of the cuff form. Certain embodiments comprise three channels 2000 angularly offset around the internal perimeter 2100 of the cuff form at intervals of 90-degrees, 180-degrees, and 270-degrees offset from the gap of the cuff form. It will be appreciated that alternate embodiments of the plurality of channels comprising straight walls, walls without undercuts, undercut sidewalls, and embodiments wherein some channels comprise undercut sidewalls while others do not, are within the spirit and scope of the present invention.

Figure 4:
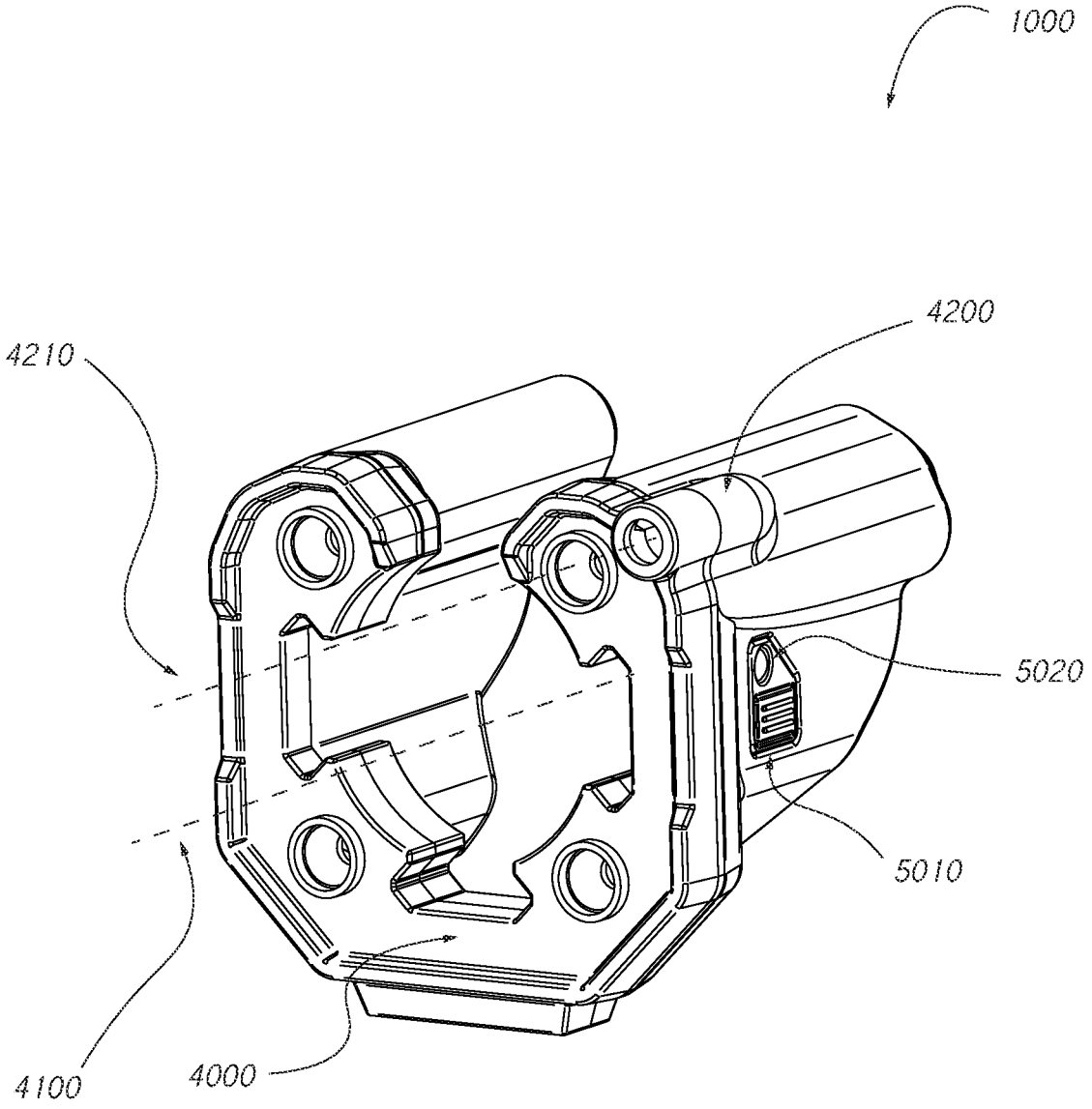
Figure 9:
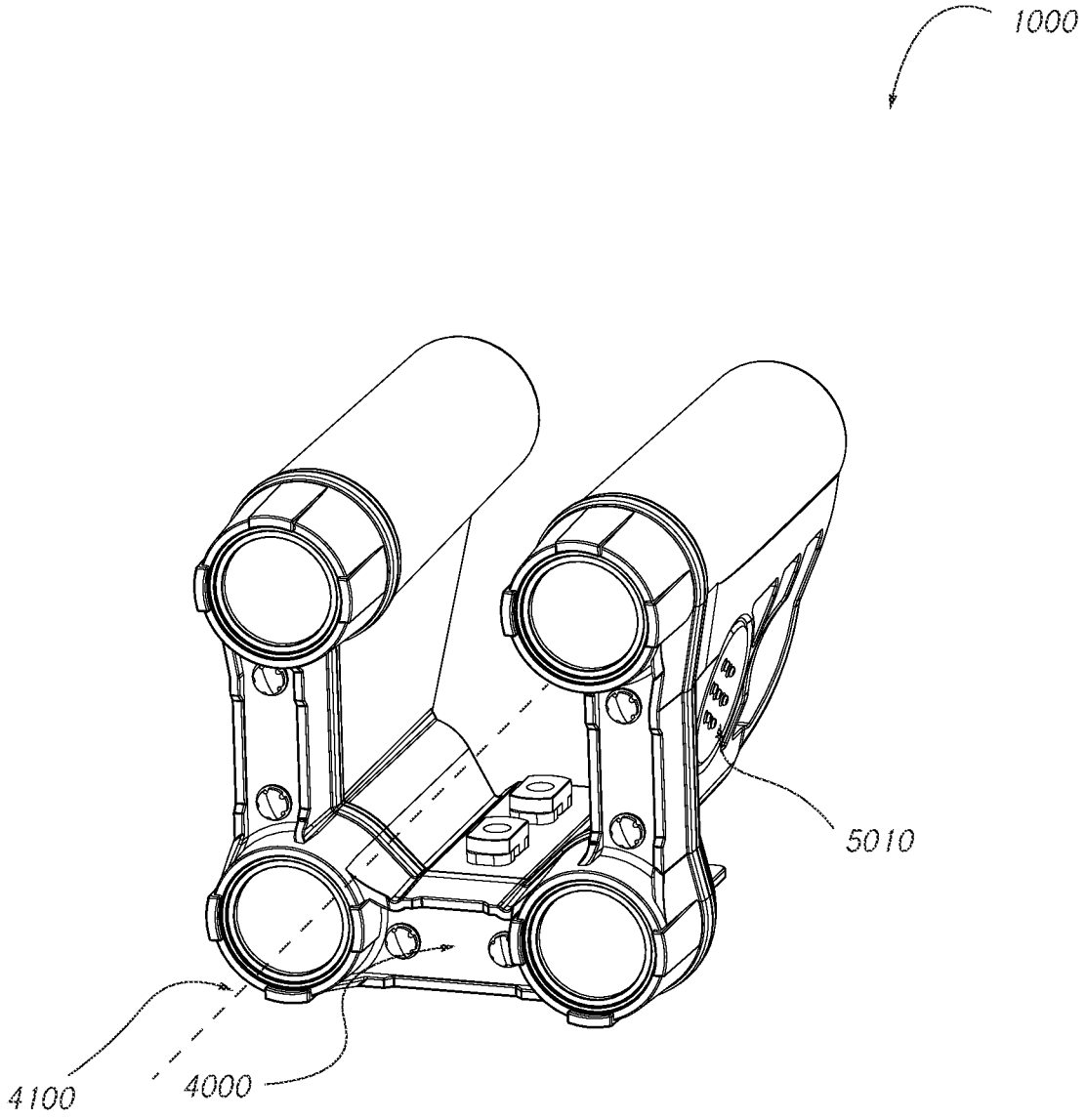

Certain embodiments of the present invention, such as shown in FIG. 4 and FIG. 9, comprise a weapon mountable illumination device 1000 having a plurality of lighting elements 1200 interconnected with a forward aspect 4000 of the cuff form wherein the lighting elements 1200 are configured to shine forward. In certain embodiments four lighting elements are equidistantly radially offset from a longitudinal axis 4100 of the pathway and are angularly offset from each other in 90-degree increments. In certain embodiments the longitudinal axis 4100 is centrally located.

Certain embodiments of the present invention, as shown in FIG. 4 and FIG. 9, comprise a weapon mountable illumination device 1000 further comprising a laser 4200 configured to emit a beam 4210 of light parallel to a longitudinal axis 4100 of a pathway of the cuff form. The laser as shown in FIG. 4 is useful in visual feedback of on-target aiming. In certain embodiments the beam 4210 is adjustable to allow for the correction of parallax error between the beam and the aimpoint of a firearm for a desired distance.

Figure 5:
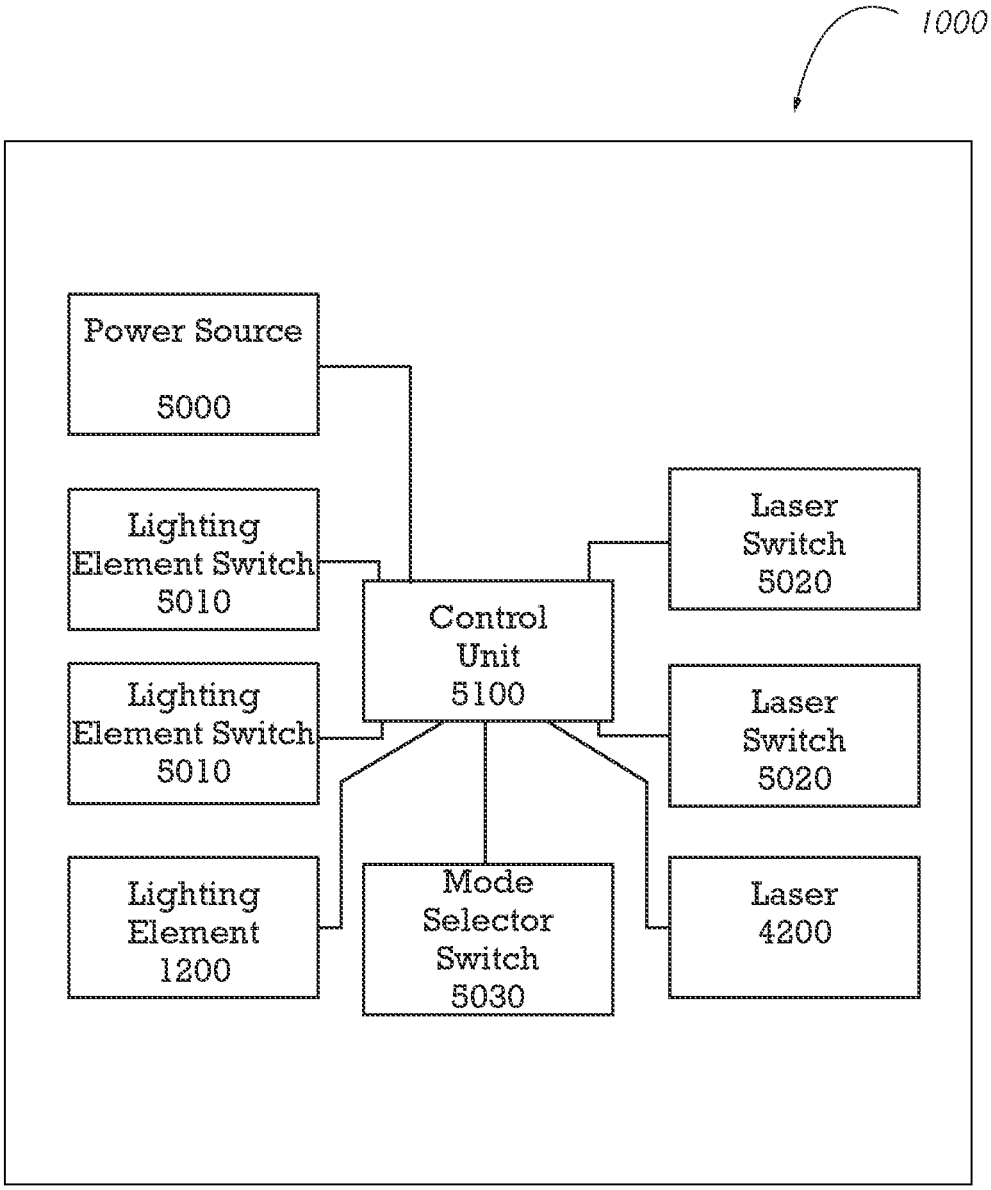

Certain embodiments of the present invention, shown in FIG. 4 and FIG. 5 and FIG. 9, comprise a weapon mountable illumination device 1000 which further comprises a power source 5000, a lighting element switch 5010 for operating a lighting element 1200, and a laser switch 5020 for operating a laser 4200 (FIG. 4) each with connection to a control unit 5100. The power source 5000 typically comprises a battery or plurality of batteries although alternate forms of power source are within the spirit and scope of the present invention.

Figure 6:
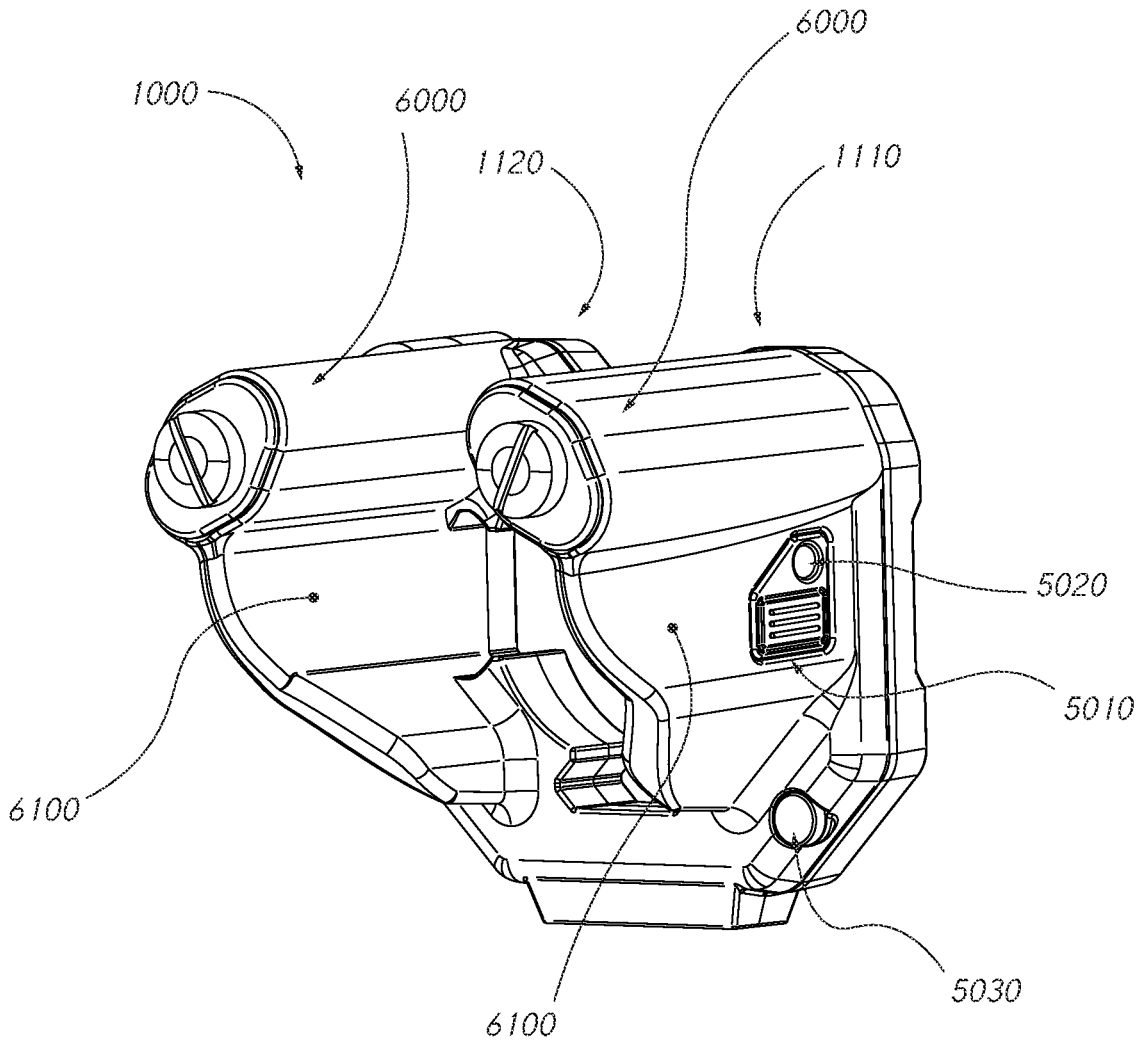
Figure 8A:
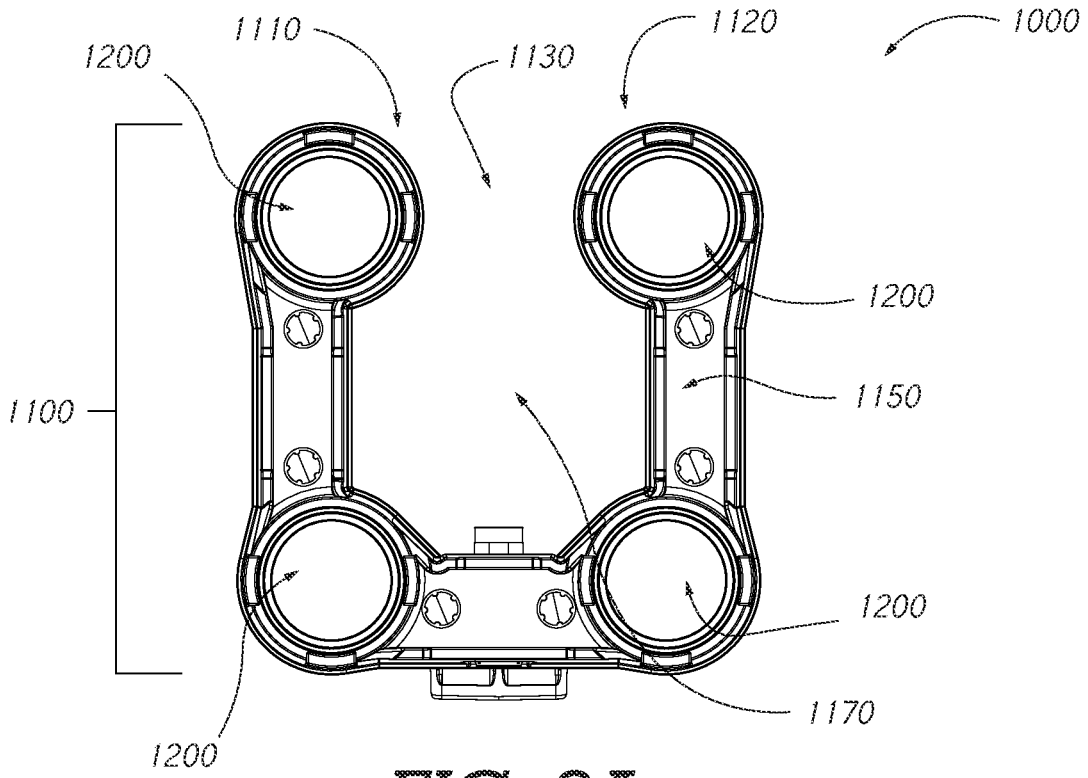
Figure 8B:
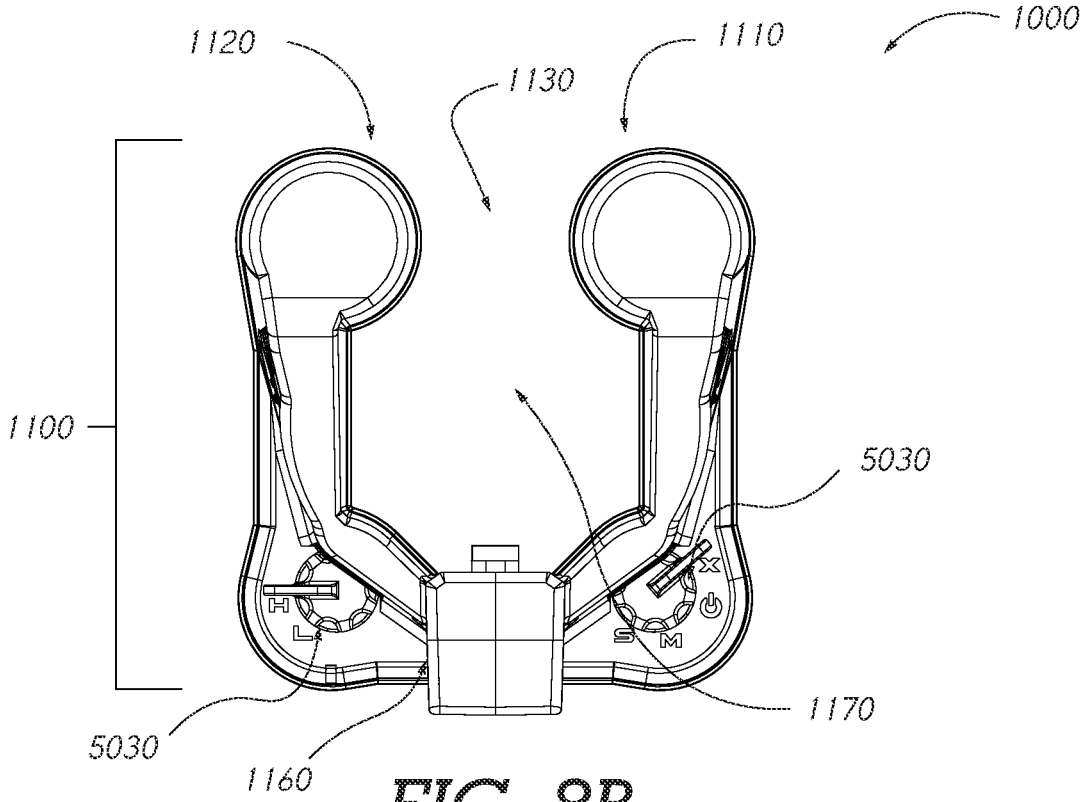
Figure 10:
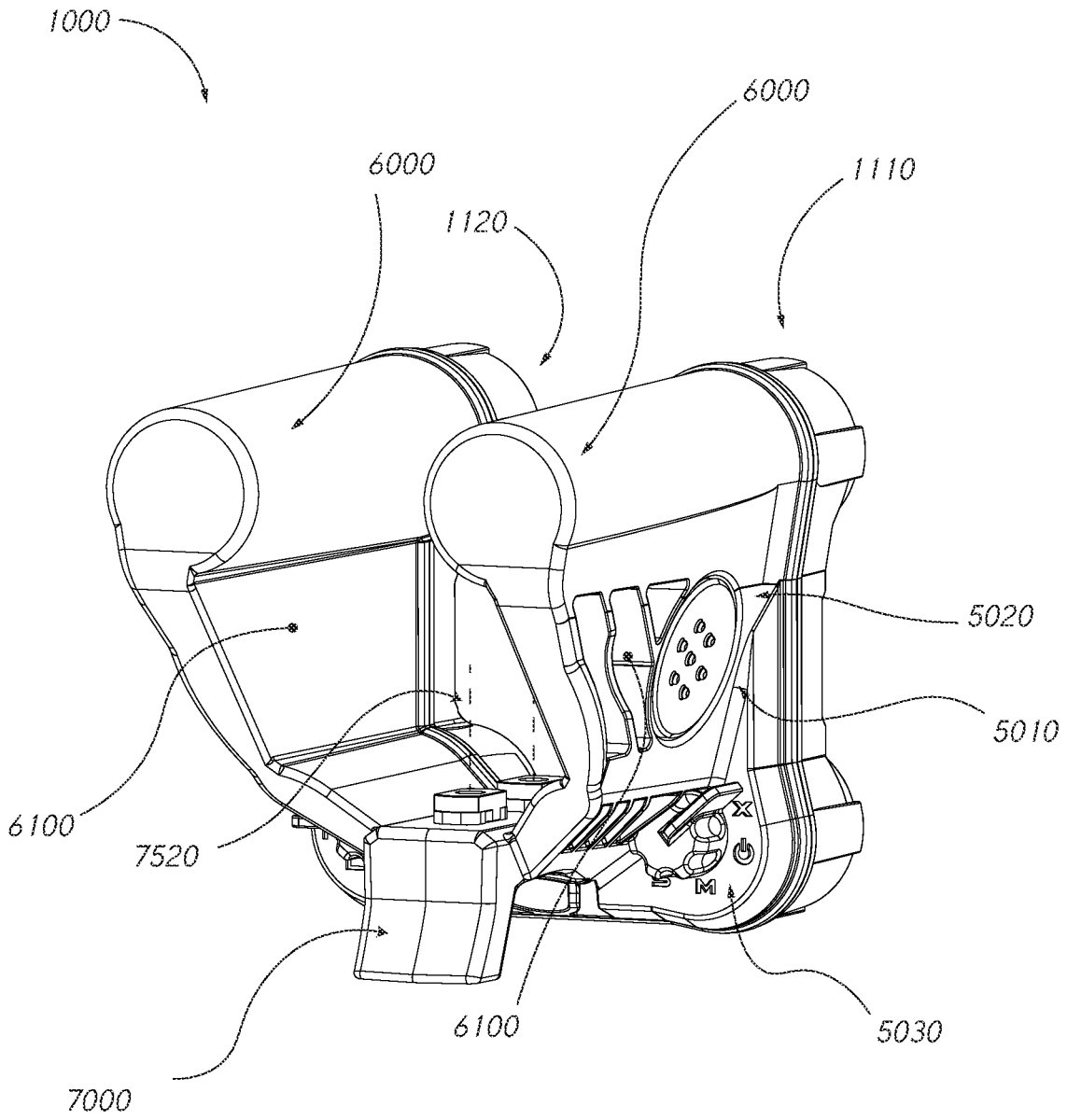

Certain embodiments of the present invention, shown in FIG. 5-FIG. 6 and FIG. 10, comprise a weapon mountable illumination device 1000 further comprising a modality switch 5030 having connection with the control unit 5100 wherein the modality switch 5030 allows an operator to select between operational modes of the lighting elements. The modality switch 5030 of certain embodiments comprise a push button wherein each press of the button advances the mode to the next mode in a sequence of selectable modes, while other embodiments comprise a rotary switch wherein each of a plurality of positions selects a particular mode associated with that position. In certain embodiments, such as shown in FIG. 8B, a second modality switch 5030 provides the ability to switch between settings such as a high and low light intensity mode.

Certain embodiments of the present invention, shown in FIG. 6-FIG. 7A, and FIG. 10-FIG. 11A for example, comprises at least one battery compartment 6000 interconnected with the cuff form 1100. In certain embodiments, as shown, a first battery compartment 6000 extends rearward form the first end 1110 of the cuff form and a second battery compartment 6000 extends rearward from the second end 1120 of the cuff form. The battery compartment 6000 of certain embodiments is waterproof while alternate embodiments comprise a battery compartment which is water resistant when the battery compartment is closed.

Certain embodiments, shown in FIG. 6-FIG. 7D and FIG. 10-FIG. 11D for example, of the present invention comprise a weapon mountable illumination device 1000 having at least one gusset 6100 interconnected between a battery compartment 6000 and the cuff form 1100. Certain embodiments, as shown comprise a first gusset 6100 interconnected between a first battery compartment 6000 and the cuff form 1100, and a second gusset 6100 interconnected between a second battery compartment 6000 and the cuff form 1100. In certain embodiments the gussets 6100 are swept radially inward to provide a lower profile to reduce snagging. It will be appreciated that the gussets as disclosed provide at least one of the following: added rigidity, lower snagging risk, increased volume to address buoyancy, added surface area for an operator to place their hand.

Figure 7A:
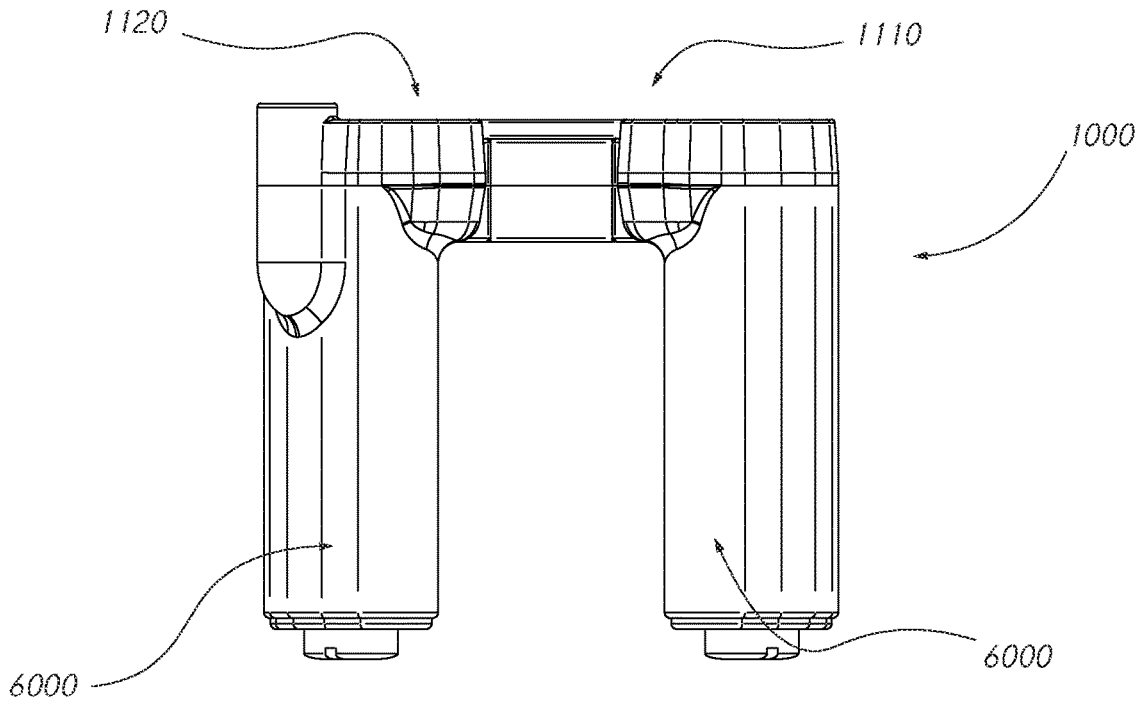
Figure 7B:
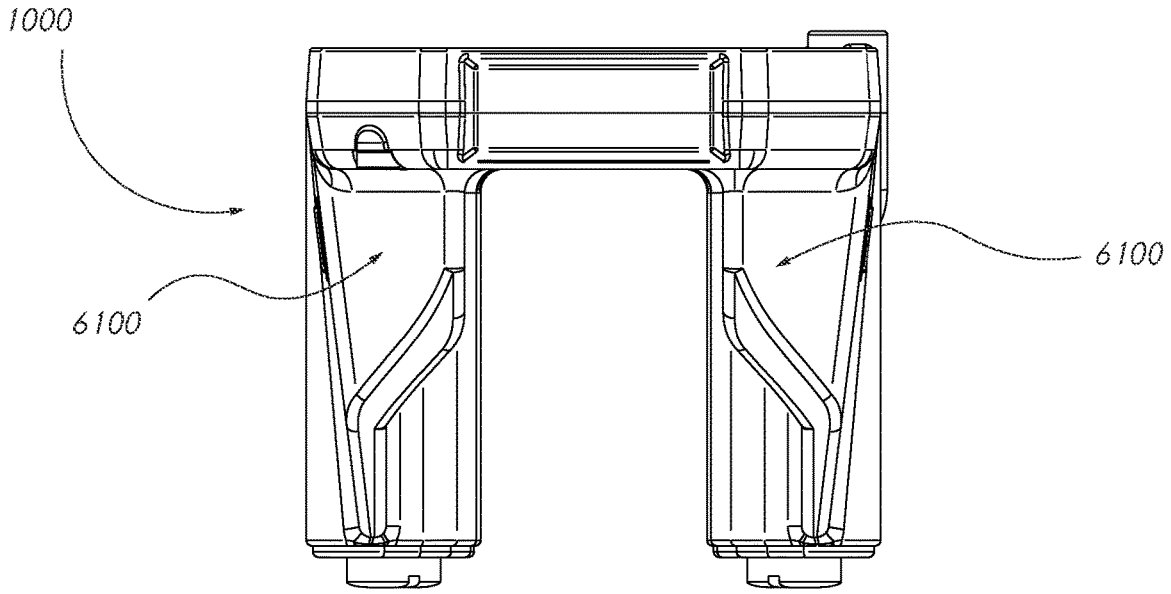
Figure 7C:
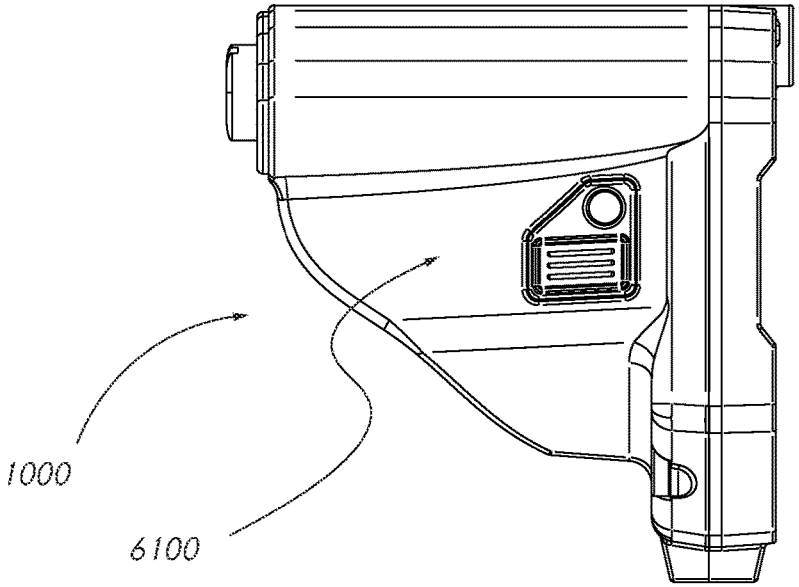
Figure 7D:
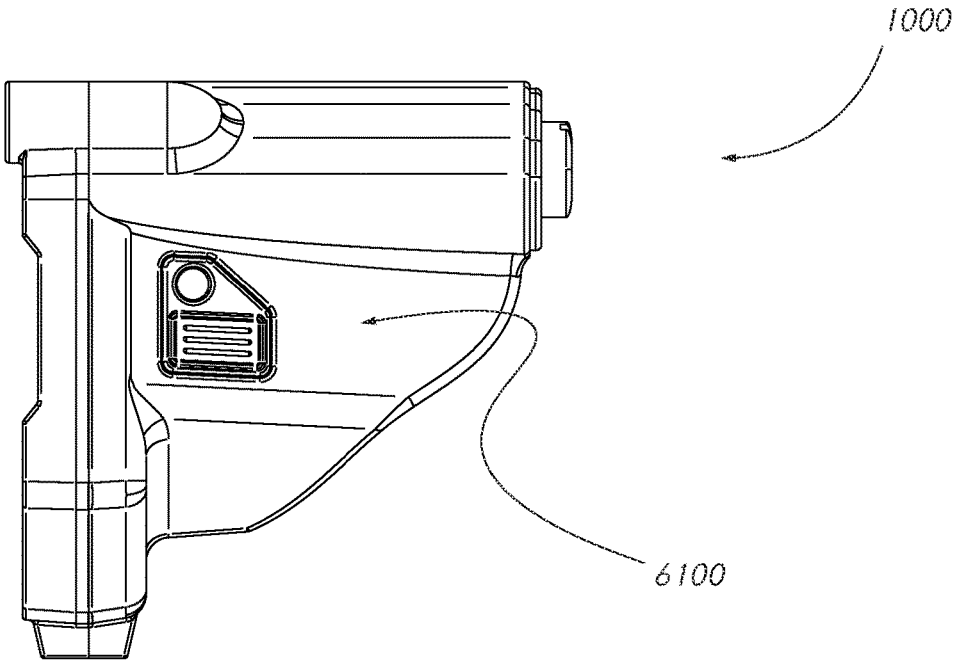

In certain embodiments, seen in FIG. 7C-7D for instance, a first gusset 6100 comprises a first lighting element switch 5010 and a first laser switch 5020, and a second gusset 6100 comprises a second lighting element switch 5010 switch and a second laser switch 5020, wherein the lighting element switches 5010 switches have identical functionality to each other, and the second lighting element switches 5020 have identical functionality to each other thus providing ambidextrous operation of the weapon mountable illumination device. Similarly, embodiments shown in FIG. 11C-FIG. 11D comprise similar functionality surrounding a first lighting switch 5010 and a second lighting element switch 5010.

Figure 11A:
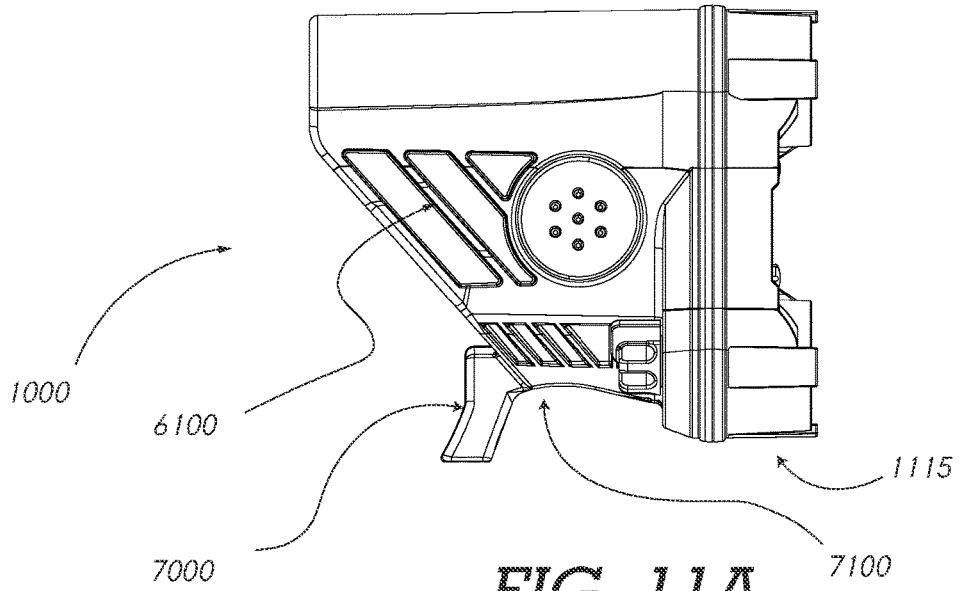
Figure 11B:
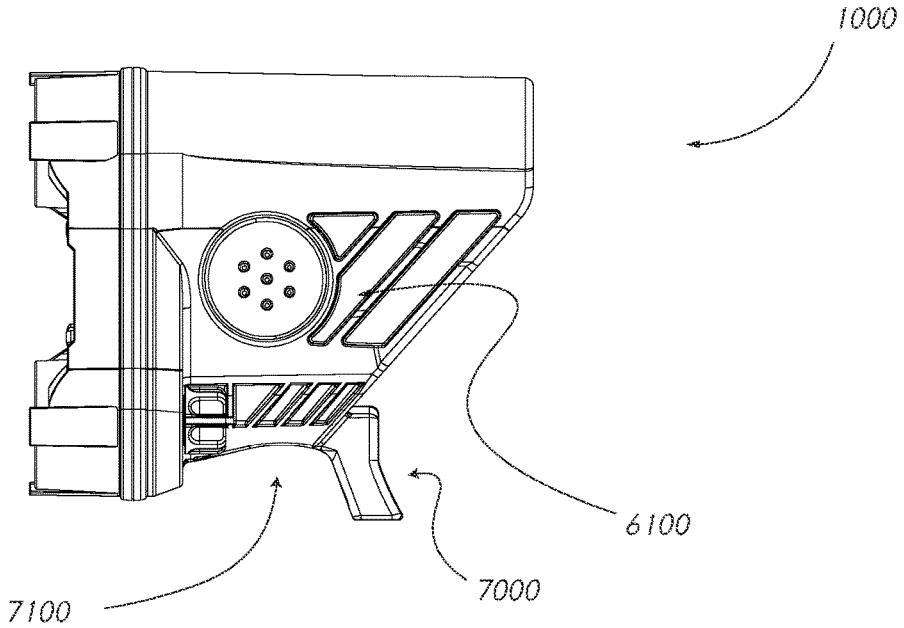
Figure 11C:
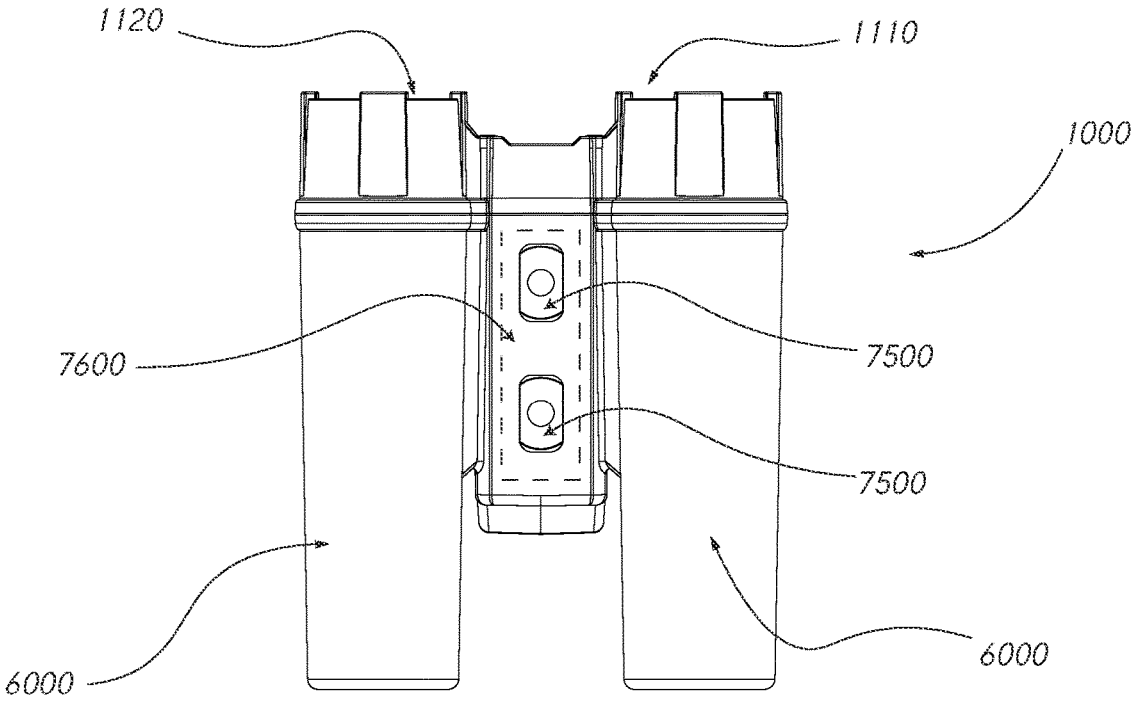
Figure 11D:
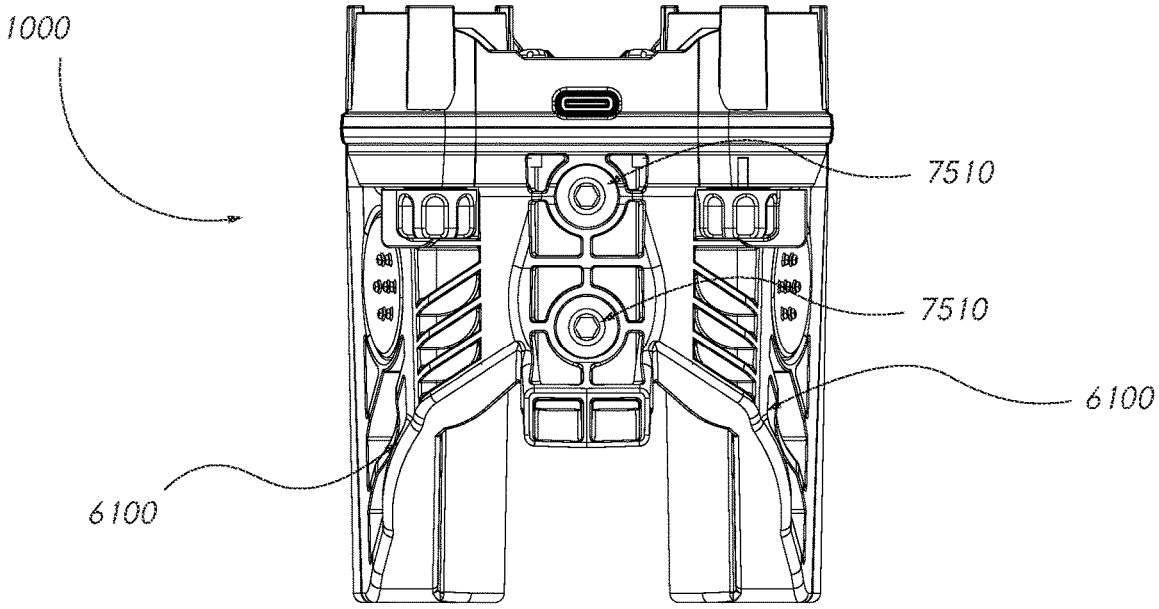
Figure 12A:
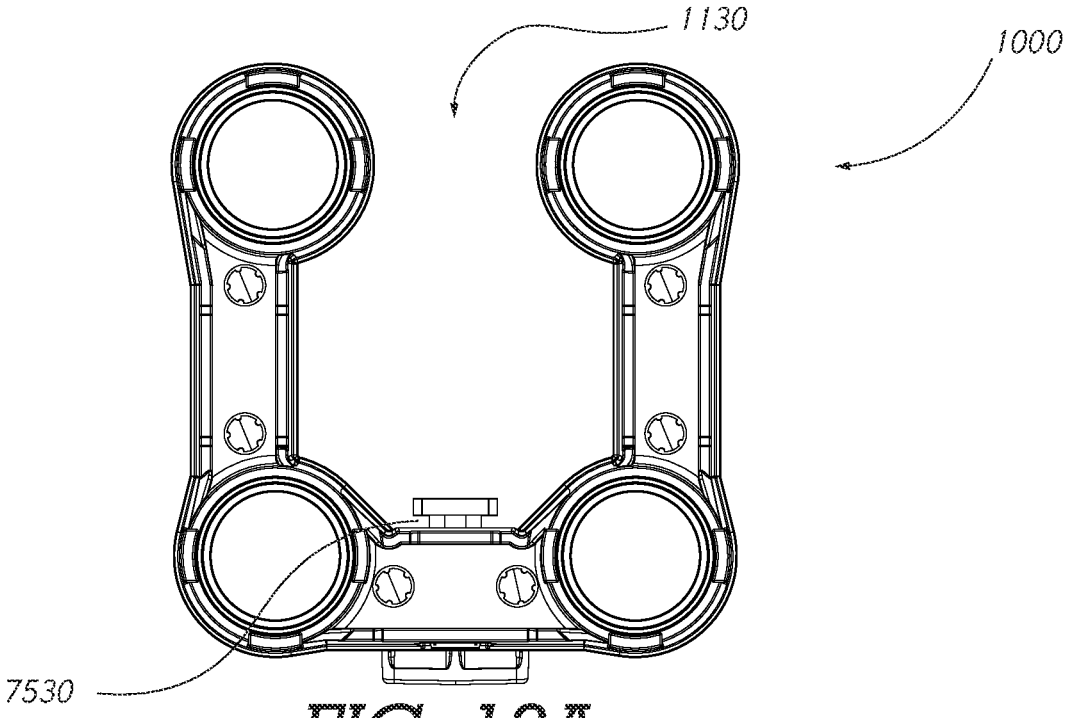
Figure 12B:
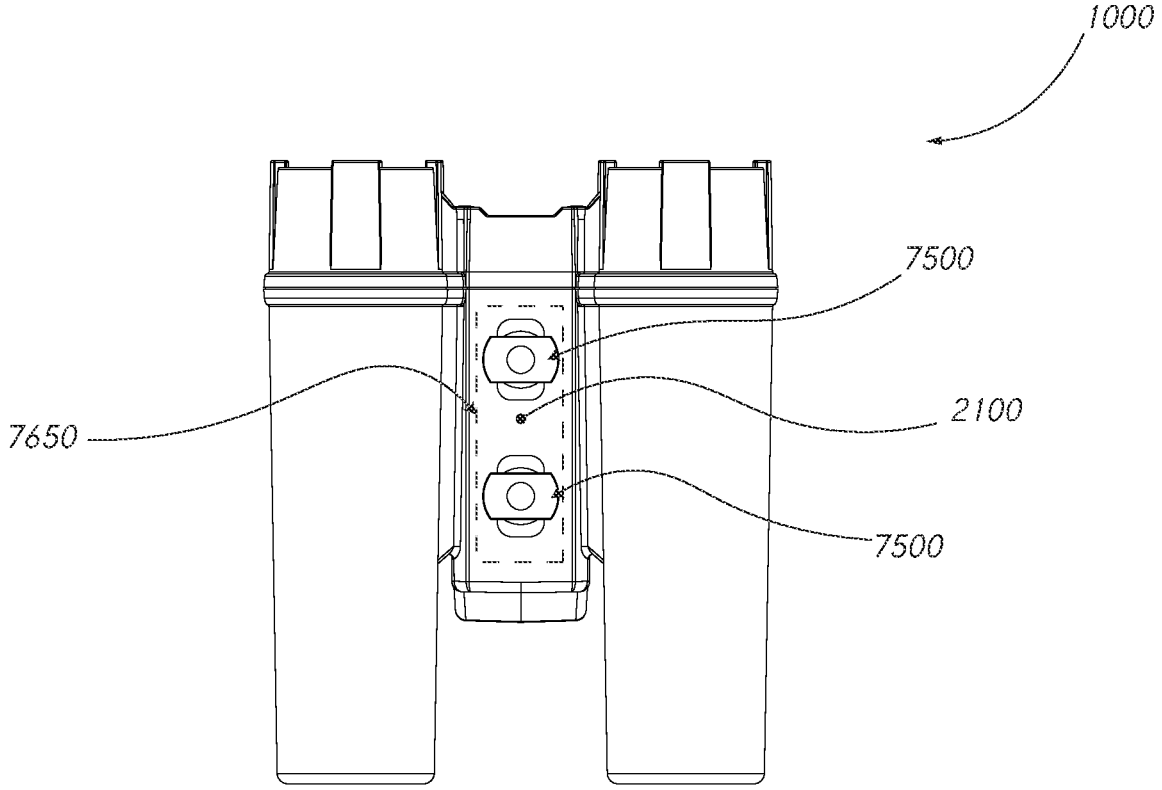

In certain embodiments of the present invention, such as shown in FIG. 10-FIG. 11B, a weapon mounted illumination device 1000 further comprises a finger hold 7000 interconnected with a surface of the weapon mounted illumination device wherein the finger hold 7000 extends radially away from an external aspect of the weapon mounted illumination device. As shown, the finger hold 7000 extends radially outward from the bottom aspect 1115 of the cuff form, but is not limited in location thereto. The finger hold 7000 provides a point of engagement wherein an operator is able to engage with a finger to further stabilize the forward aspect 9100 (FIG. 1) of the firearm. In certain embodiments, a recess 7100 is located adjacent to the finger hold in a forward direction from the finger hold 7000 to further enable the operator's engagement with weapon mounted illumination device and increase the ease of engaging a finger hold in a consistent and repeated manner. In certain embodiments, the recess 7100 comprises a concave curvature which is configured for receiving at least one finger of an operator.

In certain embodiments of the present invention, as shown in FIG. 10 and FIG. 11C-FIG. 12B, a weapon mountable illumination device 1000 is configured to interconnect with a weapon or weapon accessory having an elongated slot. In certain embodiments, the weapon mountable lighting device 1000 comprises an oblong fastener 7500 having a central axis 7520, wherein the oblong fastener 7500 comprises an offset 7530 radially inward from an internal surface 2100 of the weapon mountable illumination device. The oblong fastener 7500 is configured to be inserted through an elongated slot and then rotated about the central axis 7520 of the oblong fastener resulting in the oblong fastener 7500 interconnecting the weapon mountable illumination device 1000 to the weapon or weapon accessory. A keyed connector 7510 is interconnected with the oblong fastener wherein the keyed connector faces radially outward from an external surface of the weapon mountable illumination device. It will be appreciated that the keyed connector 7510 of certain embodiments comprises a standardized fastener such as a hex-head, torx-head or flat-head connection, however it will be further appreciated that any keyed connection is within the spirit and scope of the present invention. The oblong fasteners 7500 are typically interconnected to an internal perimeter 2100 of the weapon mountable illumination device and extend radially inward, and are preferably mounted to the internal perimeter 2100 directly opposite or 180-degrees opposed from the gap 1130. Certain embodiments of the present invention comprises a first oblong fastener 7500 and a second oblong fastener 7500 configured to be inserted through at least one elongated slot of a weapon or weapon accessory wherein the rotation of the oblong fastener 7500 results in changing from an unlocked configuration 7600 to a locked configuration 7650 and the interconnection of the weapon mountable illumination device to the weapon or weapon accessory.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A weapon mountable illumination device comprising:

a cuff form comprising a gap between a first end, and a second end;

a first open side and a second open side along a longitudinal axis, and a pathway along the longitudinal axis extending between the first open side and the second open side;

four lighting elements configured to shine forward, wherein the lighting elements comprise an angular offset of 90 degrees from each other, wherein the lighting elements are configured to produce incoherent light; and the cuff form comprising an internal perimeter, wherein the internal perimeter of the cuff form is configured to interconnect with a forward aspect of a firearm.

2. The weapon mountable illumination device of claim 1 wherein the lighting elements are equidistantly radially offset from the longitudinal axis.

3. The weapon mountable illumination device of claim 1 further comprising a laser, wherein the laser is configured to emit toward a forward end of the firearm.

4. The weapon mountable illumination device of claim 1, wherein an oblong fastener is interconnected with the internal perimeter directly opposite the gap.

5. The weapon mountable illumination device of claim 1, further comprising a first oblong fastener configured to interconnect with an elongated slot of a firearm;

the first oblong fastener comprising a central axis, and a keyed connector, wherein the insertion of the first oblong fastener through the elongated slot, and rotating the oblong fastener about the central axis by rotating the keyed connector thereby interconnects the weapon mountable illumination device to the firearm in a locked configuration.

6. The weapon mountable illumination device of claim 1, further comprising a finger hold;

the finger hold extending radially away from an external surface of the weapon mountable illumination device.

7. The weapon mountable illumination device of claim 6, wherein the finger hold extends radially away from a bottom aspect of the cuff form.

8. The weapon mountable illumination device of claim 7, further comprising a recess in the bottom aspect of the cuff form wherein the recess is located forward of the finger hold.

9. The weapon mountable illumination device of claim 1, wherein the internal perimeter of the cuff comprises a first channel offset 180-degrees from the gap.

10. The weapon mountable illumination device of claim 9, wherein the first channel comprises undercut sidewalls.

11. The weapon mountable illumination device of claim 9, wherein the internal perimeter of the cuff form further comprises a second channel, and a third channel;

the second channel has an angular offset of 90-degrees from the gap;

the third channel has an angular offset of 270-degrees from the gap; and the second channel and the third channel comprise undercut sidewalls.

12. The weapon mountable illumination device of claim 11, further comprising at least one set screw extending from an external perimeter of the cuff form, through to the internal perimeter of the cuff form, wherein the set screw is configured to affix the weapon mountable illumination device in place.

13. The weapon mountable illumination device of claim 1, further comprising:

a power source;

a control unit;

a first lighting element switch; and wherein the power source, switch, lighting element, and laser each having electrical connection to the control unit, wherein the first lighting element switch operates the lighting element.

14. The weapon mountable illumination device of claim 13, further comprising a modality switch;

the modality switch having electrical connection to the control unit, wherein the modality switch selects an operational mode for the lighting element.

15. The weapon mountable illumination device of claim 13, wherein the power source comprises a first battery and a second battery, and further comprising a first battery compartment and a second battery compartment;

wherein the battery compartments are aligned with the first end and the second end of the cuff form and extend rearward.

16. The weapon mountable illumination device of claim 15, further comprising:

a first gusset interconnected between the first battery compartment and the cuff form; and a second gusset interconnected between the second battery compartment and the cuff form.

17. The weapon mountable illumination device of claim 15, further comprising:

a second lighting element switch;

wherein the first lighting element switch is on an external surface of the first gusset, and wherein the second lighting element is on an external surface of the second gusset.

18. The weapon mountable illumination device of claim 1, wherein the lighting elements comprise LEDs.

19. A weapon mountable illumination device comprising:

a cuff form comprising a gap between a first end, and a second end;

a first open side, and a second open side along a longitudinal axis, and a pathway along the longitudinal axis extending between the first open side and the second open side;

four lighting elements configured to shine forward, the lighting elements equidistantly radially offset from the longitudinal axis of the pathway, and the lighting elements having an angular offset of 90-degrees from each other;

a power source;

a control unit;

a first lighting element switch, and a second lighting element switch, which operate the lighting elements; and a modality switch comprising a rotatory switch with a plurality of positions;

the power source, the switches, and the lighting elements each having electrical connection to the control unit;

a first battery compartment and a second battery compartment, the battery compartments are aligned with the first end and the second end of the cuff form and extend rearward;

a first gusset interconnected between the first battery compartment and the cuff form; and a second gusset interconnected between the second battery compartment and the cuff form;

wherein the first lighting element switch is interconnected to the first gusset, and wherein the second lighting element switch is interconnected to the second gusset.

* * * * *